US005997027A

United States Patent [19]

Jungkind

[11] Patent Number: 5,997,027

[45] Date of Patent: Dec. 7, 1999

[54] ARBITRARILY CLOSABLE AND RELEASABLE CONNECTING BINDING

[75] Inventor: Roland Jungkind, Garmisch-Partenkirchen, Germany

[73] Assignee: MS Trade Handels GmbH, Germany

[21] Appl. No.: 09/167,345

[22] Filed: Oct. 7, 1998

[30] Foreign Application Priority Data

Oct. 9, 1997 [DE] Germany ..... 197 44 613

[51] Int. Cl.[6] ..... A63C 9/00; A63C 9/10; A62B 9/04

[52] U.S. Cl. ..... 280/617; 280/14.2; 280/626

[58] Field of Search ..... 280/14.2, 613, 280/617, 623, 625, 631, 626, 616; 403/322.4

[56] References Cited

U.S. PATENT DOCUMENTS 4,058,326 11/1977 Faulin ..... 280/617
5,556,123 9/1996 Fournier ..... 280/617

FOREIGN PATENT DOCUMENTS 0 824 942 A1 2/1998 European Pat. Off. .
2 720 655 12/1995 France .

*Primary Examiner*—Lanna Mai
*Assistant Examiner*—Jeff Restifo
*Attorney, Agent, or Firm*—Austin R. Miller

[57] ABSTRACT

A device for connecting a piece of sports equipment, fixedly attached to the equipment, to securely hold a user's foot to the sports equipment having an instep element and a pivotable heel element, which are connected to one another in a manner that they each execute an opposed movement. The instep element is linked to a baseplate attached to the piece of sports equipment with the interconnection of a clamping lever by a connecting link coupled to the clamping lever and further connecting the clamping lever to the heel element forming the toggle joint of a tilting lever that is acted upon by a spring, which secures the instep element and heel element in their respective boundary position and counteract a change in position until the extended position of the tilting lever is reached in order to achieve rapid and simple closing and release of the connection between the foot and the piece of sports equipment while avoiding unintentional release during sports activity.

21 Claims, 8 Drawing Sheets

ARBITRARILY CLOSABLE AND RELEASABLE CONNECTING BINDING

Figure 1:
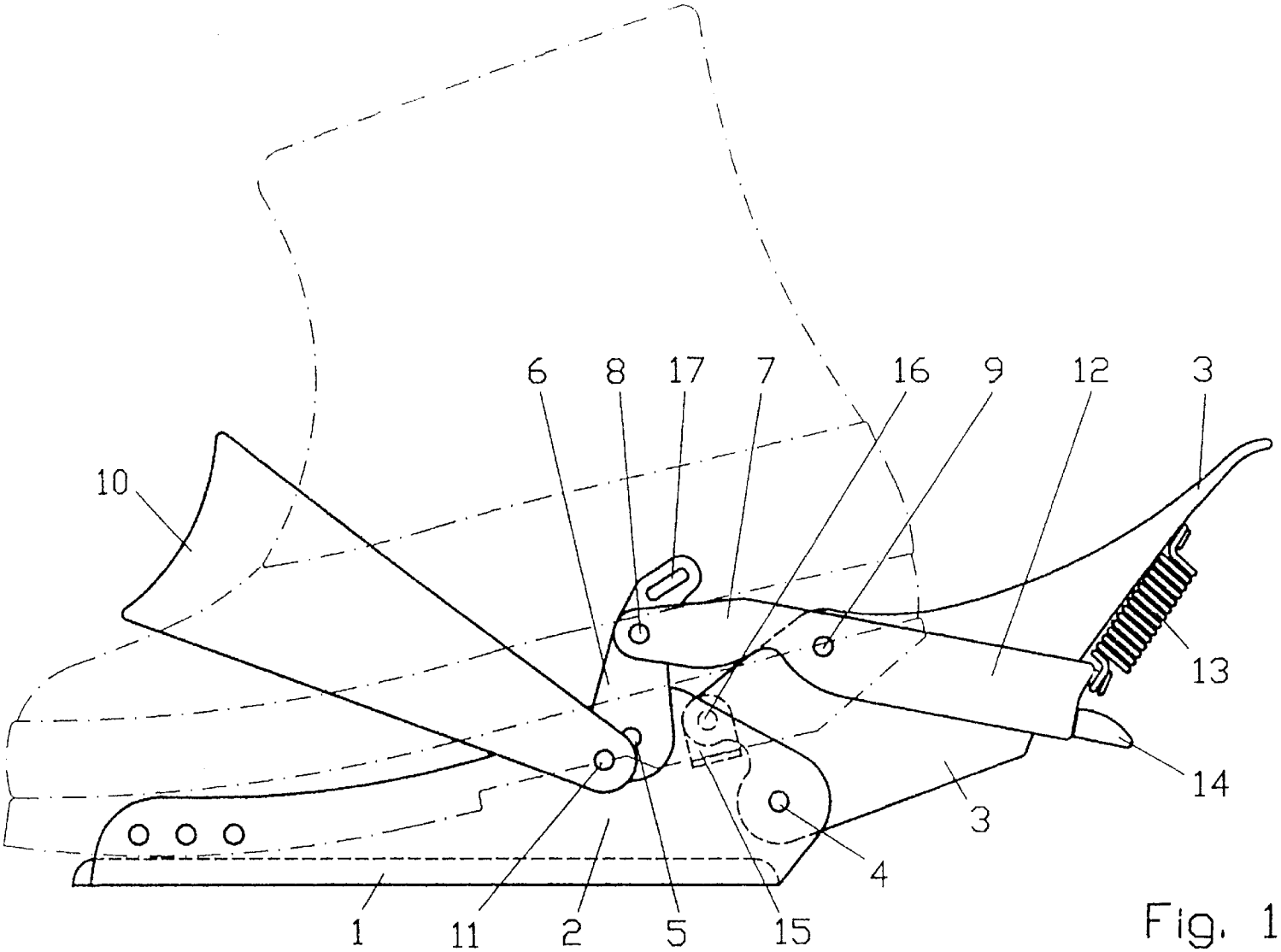

The invention relates to an arbitrarily closable and releasable connecting device to connect a piece of sports equipment to a user's foot, preferably wearing a sports shoe, which connecting device is assigned to the piece of sports equipment directly, or indirectly via a baseplate, and which has an instep element preferably in the form of a belt and a heel element which can be pivoted about a transverse axis, which elements are connected to one another in such a manner that by an opposed movement they pass from a position releasing the foot into a securing position for the foot and vice versa.

Connecting devices of this type are disclosed, for example in DE 196 42 887 A1. They may be used in a multiplicity of sports equipment, such as roller skates, ice skates, snowboards, downhill skis and water skis. In most of these connecting devices, the heel element is lengthened downwards beyond its pivot, the instep element adjoining this lengthened portion. The abovementioned publication has also disclosed connecting devices in which the instep element and heel element are connected by a cable which is guided via at least one deflection roller. However, these designs have not become popular in practice since they allow the inevitable, simultaneous opposed movement of the two elements only in the direction of the closing position as compressive forces are unable to be transmitted via a cable.

A catch is provided on the heel element to secure the closing position of the connecting devices. For a start, the catch concerns conventional clamping buckles which can be guided around the user's lower leg. In another design, use is made of a tilting lever between the piece of sports equipment and the heel element, which tilting lever, after extending and exceeding the dead centre, secures the closing position only by clamping the heel element.

Whereas the first catch is awkward, the second is insecure. This has also not been disclosed up to now in practice.

Therefore, the main purpose of the present invention is to design and configure a connecting device of the generic type in such a manner that the closing and release of the connection of a foot to a piece of sports equipment can be handled in a rapid and simple manner, and in that the risk of unintentional release during use is reliably avoided.

According to the invention, this is achieved in that at least one connecting end of the instep element is held on the piece of sports equipment or on the baseplate with the interconnection of a clamping lever, in that a connecting link is coupled to the clamping lever, which connecting link connects the said clamping lever to the heel element, in that this coupling point forms the toggle joint of a tilting lever which, on the one hand, consists of the clamping lever and, on the other hand, of the connecting link and the heel element, and in that the tilting lever is acted upon by a spring which secures the instep element and the heel element in their respective boundary position and counteracts a change in position until the extended position of the tilting lever is reached.

The closing and release of the connection takes place in a simple manner by appropriately pivoting the heel element on the lower leg or away from the latter. Unintentional pivoting-away is virtually impossible due to the resistance of the spring.

For good positioning and holding of the foot or shoe, it is expedient if the instep element is held on each side of the foot by the two connecting ends via a respective clamping lever, and at the same time the two clamping levers are connected to the heel element by means of a respective connecting link, the corresponding joints of the four-bar linkages lying coaxially to one another on both sides.

Preferably, at least one connecting link is lengthened beyond its coupling point on the heel element, the spring then acting upon this lengthened portion.

In a first embodiment of the invention, it is provided that, in its extended position, the toggle joint of the tilting lever is located in front of its two other joints, while a second embodiment provides that in the extended position, the toggle joint lies between the two other joints.

A further purpose of the invention is for the connecting device to automatically close on introduction of the foot or shoe in order to facilitate putting-on of the piece of sports equipment. For this purpose, the heel element is provided with a step clip which, starting from the closed position, lies below the coupling of the connecting link. In a constructive refinement of this concept, the step clip may be held such that it can move with respect to the heel element. This in particular allows a relatively large surface area design of the step clip.

An advantageous feature of the first embodiment mentioned above is that it is possible either for the clamping lever or the connecting link to be lengthened forwards beyond the joint connecting them and for this lengthened portion to form the connecting member for a handle. In this case, a catch strap or the like can be used as the handle. Pulling on this causes the spring force to be overcome and results in the tilting lever extending and in a change in position of the connecting device from the securing position into the release position. The advantage of avoiding a clamping buckle comes fully to bear here.

In a development of the invention, the two connecting links are combined to form a U or open O which engages around the outside of the heel element. The web part of the connecting link may be used here as an application point for the spring.

With reference to the first embodiment mentioned above, in this case it is preferably possible for the spring to be a tensile spring which is hung onto the heel element above the web part of the connecting link.

With further reference to this embodiment, it is possible for the web part of the connecting link to have a lug on the outside, the lug, by being pressed upon, causing the connecting link to pivot counter to the spring force and thus intentionally to open the connecting device. This opening option is particularly of advantage in a constrained position.

In the second embodiment mentioned above, the spring can likewise be a tensile spring if it loads the lengthened portion of the connecting link downwards. In this case, the tensile spring is expediently hung onto its spindle on the side of the heel element.

In a further structural refinement of this embodiment, it is provided that, as a handle, the web part of the connecting link has guided around it a cable or strap, one end of which is fastened to the upper, outside region of the heel element and the other free end of which extends upwards through an eyelet on the heel element. This gives a desirably low opening force.

A finger loop may be provided at the free end of the handle, or else the free end may be designed as a catch strap.

Figure 2:
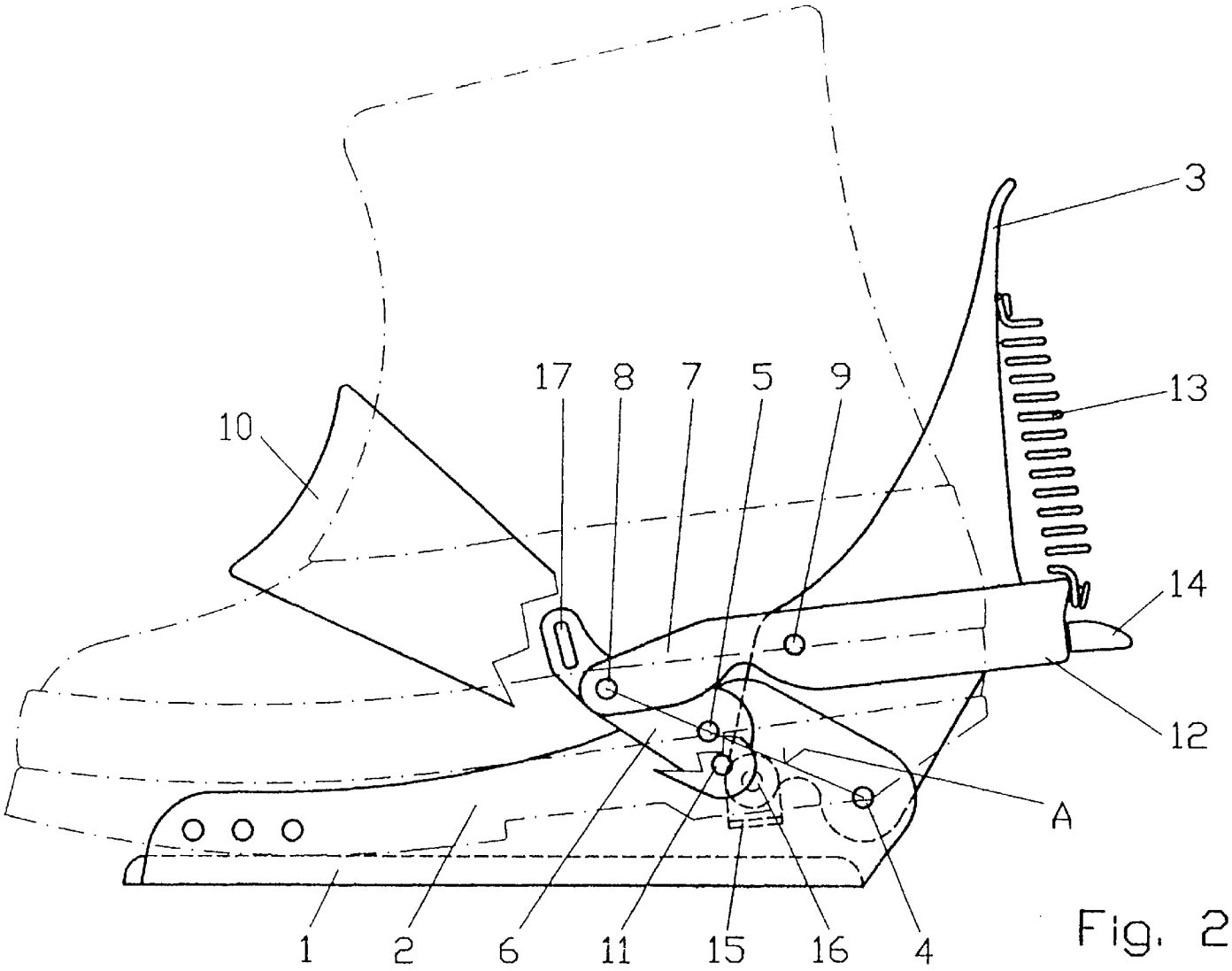
Figure 3:
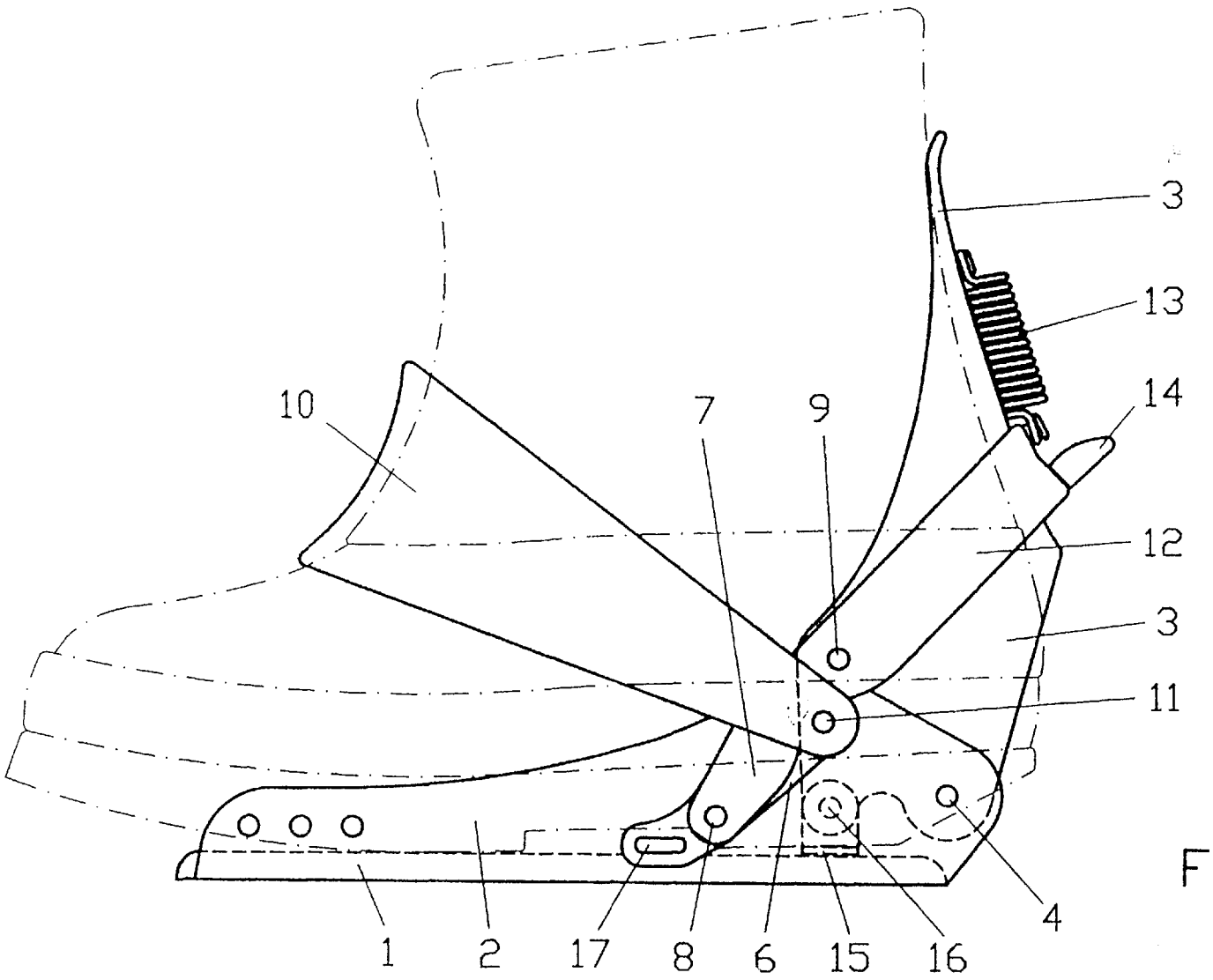
Figure 4:
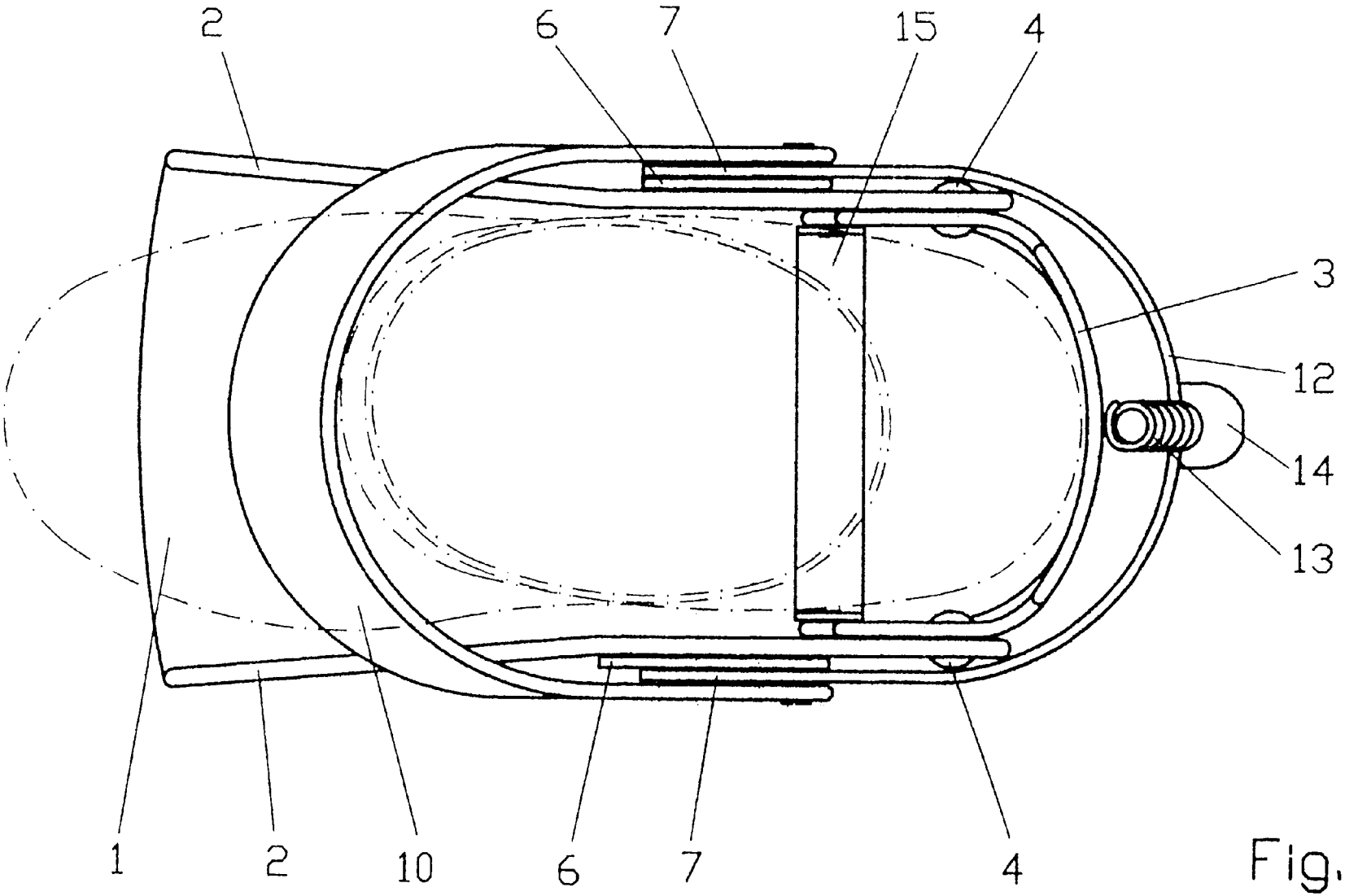
Figure 5:
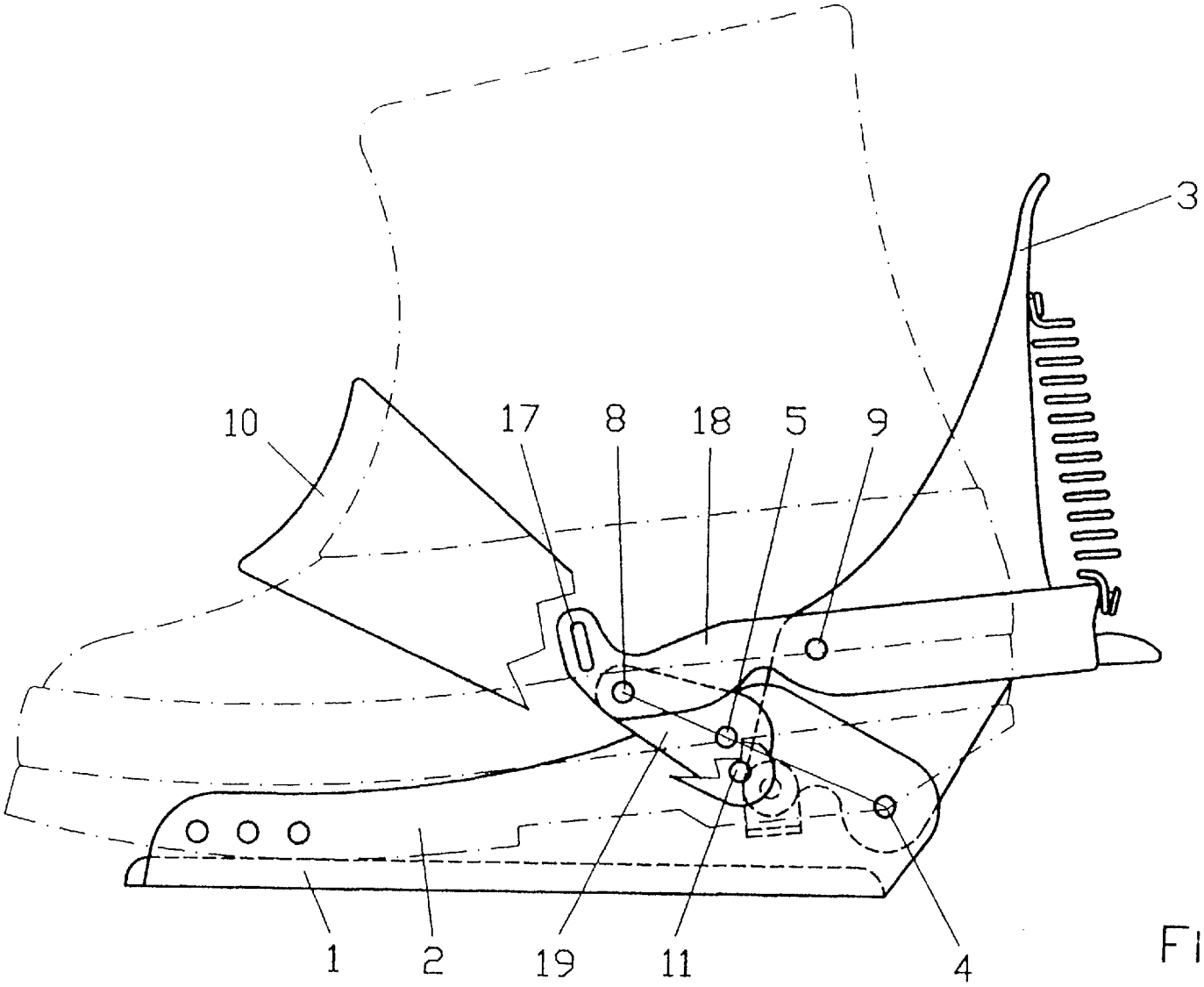
Figure 6:
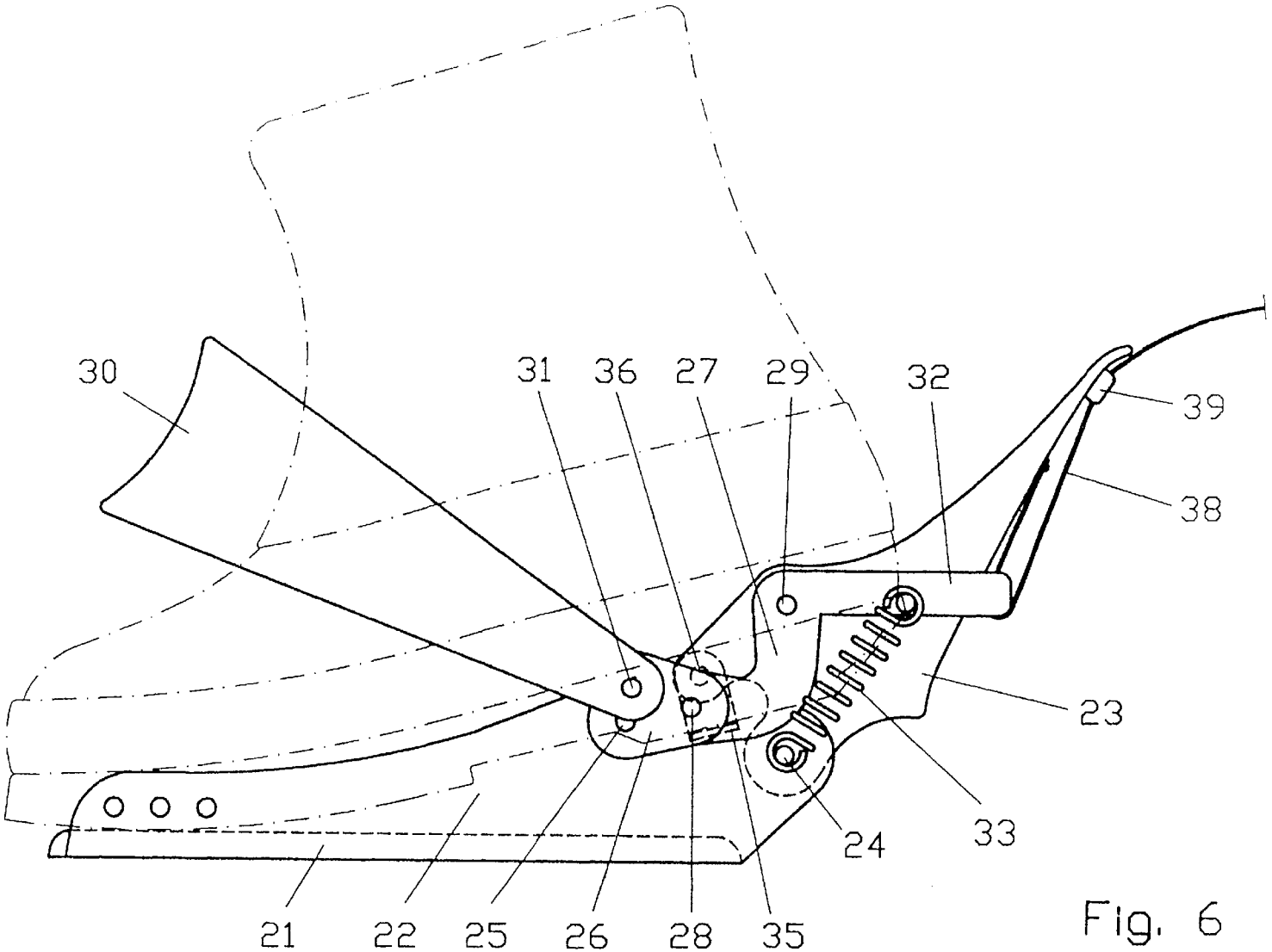

In the following, exemplary embodiments of the subject matter of the invention are described with reference to the enclosed drawings. In the drawings:

FIG. 1 shows a side view of a connecting device according to a first design, in an opened state, FIG. 2 shows the connecting device according to FIG. 1 in the transient state with the tilting lever extended, FIG. 3 shows the connecting device according to FIGS. 1 and 2 in the closed state, FIG. 4 shows a plan view of FIG. 3, FIG. 5 shows a representation corresponding to FIG. 2 of a varied design, FIG. 6 shows a side view of a connecting device according to a third design in an open state.

Figure 7:
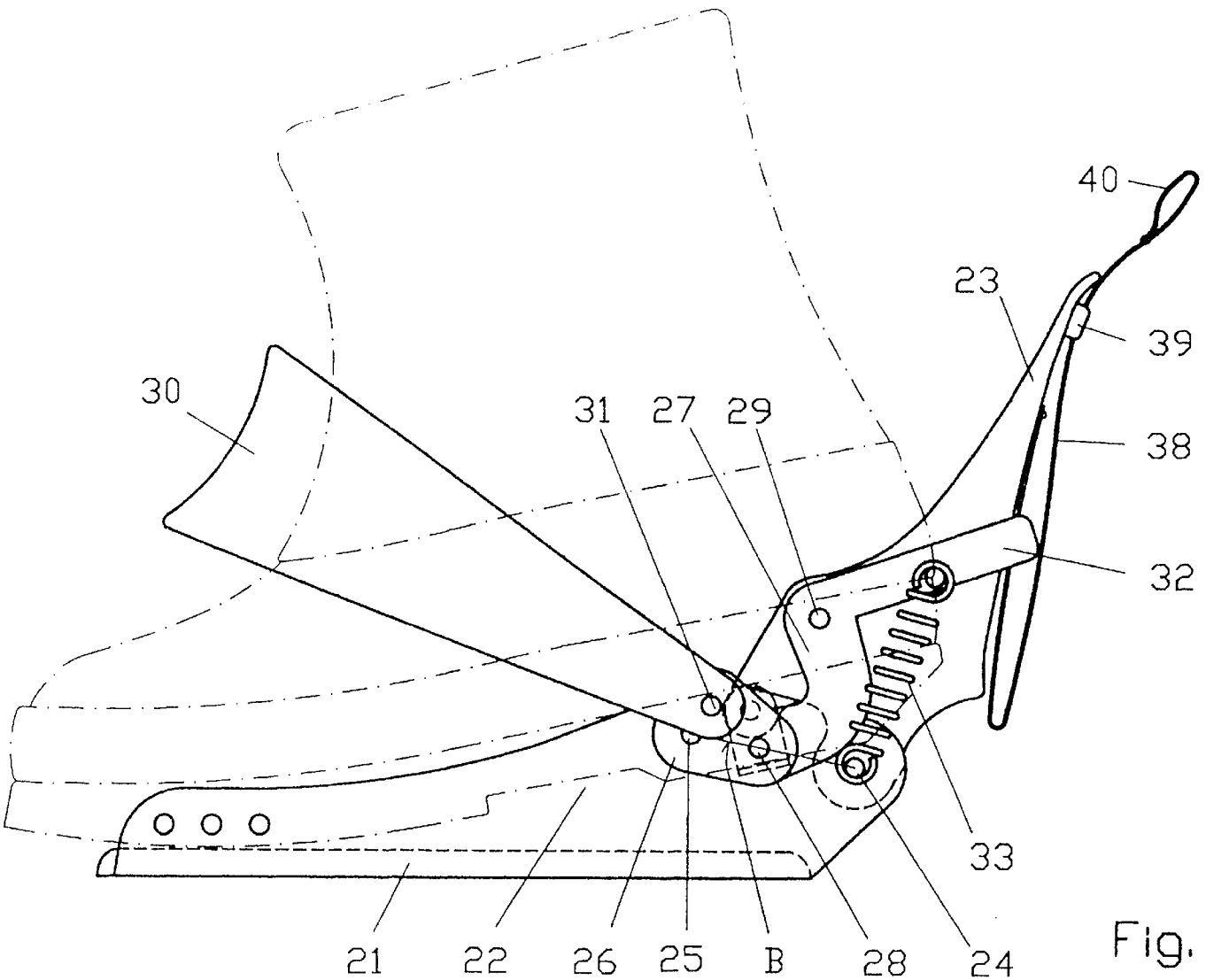
Figure 8:
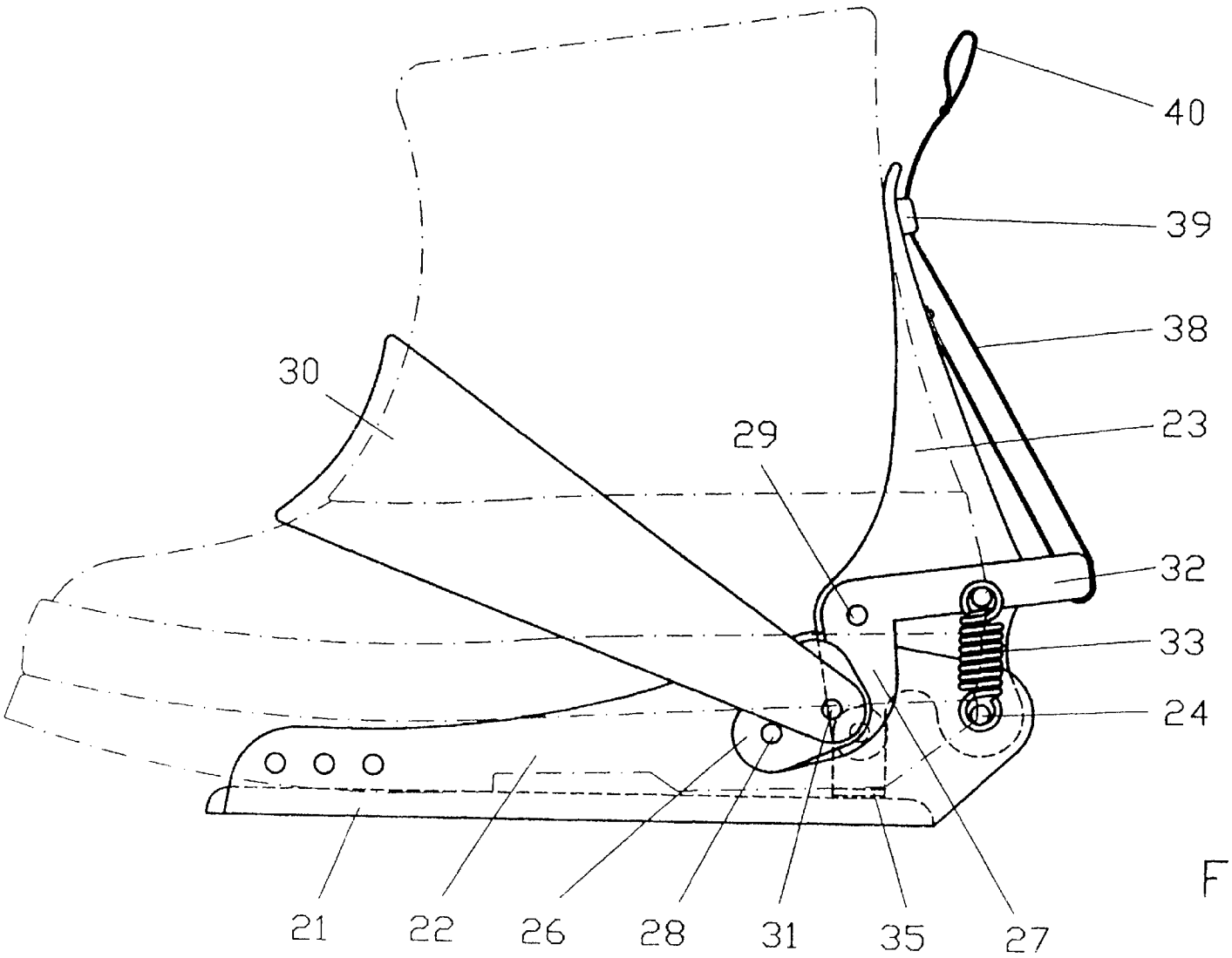

FIG. 7 shows the connecting device according to FIG. 6 in a transient state with the tilting lever extended, FIG. 8 shows the connecting device according to FIGS. 6 and 7 in a closed state.

In the designs represented by way of example, the connecting devices according to the invention serve to connect a relatively soft snowboard shoe, which is represented by dash-dotted lines, to a snowboard (not shown) , the connection taking place indirectly via a baseplate 1 or 21 which can be fastened on the snowboard in a known manner and has upright, mirror-symmetrical, lateral flanges 2 or 22 to laterally guide the shoe sole.

In the design according to FIGS. 1 to 4, a heel element 3 is mounted pivotably on the flanges 2 of a baseplate 1 by means of spindles 4. In a manner which is known and is therefore not described in more detail, the heel element is of a correspondingly concave design to grasp and hold the end of the shoe. Two clamping levers 6 are mounted such that they can be pivoted coaxially to one another on the flanges 2 in each case by means of a spindle 5, the clamping levers being connected in a hinged manner to the heel element via a respective connecting link 7. 8 indicates the coupling point of the connecting link on the clamping lever, while the coupling point of the connecting link to the heel element bears the reference number 9.

An instep element 10 in the form of a belt is connected pivotably by its two ends to the clamping levers 6 in each case via a spindle 11. Appropriate arrangement of the spindles has the effect that a movement of the heel element 3 causes an opposed movement of the instep element 10.

The two connecting links 7 are lengthened beyond their coupling points 9 and are combined to form a horseshoe-shaped part 12 which grasps around the outside of the heel element 3. The end of the part 12 is acted upon by one end of a tensile spring 13 whose other end is hung onto the heel element, in the vicinity of its free end. Finally, an opening lug 14 is furthermore situated on the part 12, below the tensile-spring fastening.

According to an essential feature of the invention, a step clip 15 is furthermore provided between the two front, lower edges of the heel element 3. The step clip is coupled to the heel element via two spindles 16.

The clamping lever 6, which with reference to FIG. 1 lies in the plane of projection, is lengthened beyond the coupling point 8 of the connecting link 7. This lengthened portion serves as a connecting member for a handle. For this purpose, it is provided with an elongated hole 17 through which a catch strap (not shown) may, for example, be guided.

FIG. 4 reveals how in particular the parts 2, 6 and 7 (present in duplicate) of the connecting device are arranged on each side of the shoe.

In FIG. 1 the connecting device is represented in an opened state in which stepping on and off is possible. The front end of the sole of the shoe (outlined by dash-dotted lines) bears against the baseplate 1, while the heel region of the sole rests on the step clip 15. As the shoe is trod downwards, the heel element 3 pivots counterclockwise (with respect to the illustration) with the consequence that the coupling links 7 and the clamping lever 6 also pivot. Via the clamping lever 6, the instep element 10 is pulled towards the shoe. The relative movement of the coupling links 7 and hence of the part 12 with respect to the heel element causes the tensile spring 13 to be tensioned until the position according to FIG. 2 is reached. In this figure, the instep element 10 is not drawn with solid lines so as to give a better view of the parts lying beneath it.

In the position according to FIG. 2, a tilting lever formed, on the one hand, from the clamping lever 6 and, on the other hand, from the connecting link 7 and the heel element 3, is situated in its extended or dead centre position. This means that the coupling point 5 forming the toggle joint lies between the spindles 4 and 8 in the extended portion of the straight connecting lines A. The tensile spring 13 is tensioned until this point is reached.

Further movement of this unit into the closing position according to FIG. 3 is assisted by the force of the tensile spring 13. This enables the shoe to be brought into its end position and to be held between the instep element 10, which is being tensioned further, and the heel element 3. The tensile spring 13 ensures that this state is maintained while the piece of sports equipment is being used without special manipulations being required, for example in the form of closing buckles.

The connecting device can be opened in two ways. Firstly, it can take place with the aid of a handle (not shown), for example a catch strap which is guided through the elongated hole 17 and in this manner is connected to the clamping lever 6. Pulling on the catch strap causes the unit 3, 6, 7, 10 to be transferred from the position according to FIG. 3 into the position according to FIG. 1. The first part of the movement as far as the position according to FIG. 2 takes place counter to the force of the tensile spring 13, while the subsequent part of the movement is assisted by the force of the tensile spring.

The second option for opening the connecting device is provided by applying pressure to the opening lug 14 at the end of the horseshoe-shaped part 12. The opening procedure itself corresponds to that described above.

The design of the connecting device according to FIG. 5 differs only slightly from that described above according to FIGS. 1 to 4. For this reason, the same reference numbers are used for identical parts. Only the point of application for the opening handle has been shifted. In this case, it is the connecting link 18 which is lengthened beyond the coupling point 8, rather than the clamping lever 19. In the lengthened portion there is again an elongated hole 17 for a catch strap, for example, or another suitable pull-type member.

As in the previously described designs, the connecting device according to FIGS. 6 to 8 has, as a base, a baseplate which is denoted by 21 and has lateral flanges 22. On the latter, a heel element 23 is mounted such that it can pivot about spindles 24 and a respective clamping lever 26 is mounted such that it can pivot in each case about a spindle 25. The hinged connection of the clamping lever to the heel element again takes place at coupling points 28 and 29 via connecting links 27. An instep element 30 is likewise connected pivotably by its ends to the clamping levers 26 via a spindle 31 in each case.

Similarly, in the present example, the connecting links 27 are lengthened beyond their coupling points 29 and are combined to form a horseshoe-shaped part 32. A tensile spring 33 is preferably fastened to each of the two lengthened portions and is hung by its other end onto the spindle 24. The web of the horseshoe-shaped part 32 has guided around it a strap 38 whose inner end is fastened to the heel element 23 at a sufficient distance above the web. The free end of the strap is guided upwards through an eyelet 39 on the heel element and is configured as a finger loop 40 (cf. FIGS. 7 and 8).

In a similar manner as in the designs according to FIGS. 1 to 5, in the present case too a step clip 35 is again coupled to the front, lower edges of the heel element 23 by means of spindles 36. The coupling permits the step clip to be designed such that it has a large surface area which thereby virtually eliminates the possibility of profiled soles becoming caught on the pedal.

With reference to FIG. 6, as the shoe is being trod downwards via the step clip 35, the heel element 23 is pivoted towards the shoe. At the same time, the kinematic connection causes the instep element 30 likewise to be pulled towards the shoe. However, in contrast to the first design, in this case the clamping levers 26 pivot clockwise (with respect to the illustration) about their spindles 25. The tensile spring 33 is tensioned until the position according to FIG. 7 is reached.

In the position according to FIG. 7, the tilting lever, which again consists, on the one hand, of the clamping lever 26 and, on the other hand, of the heel element 23 and the connecting link 27, is located in its extended or dead centre position in which the coupling point 28 forming the toggle joint on the straight connecting lines B lies between the spindles 24 and 25.

As is known from the first design, further movement into the closing position according to FIG. 8 is assisted by the force of the tensile spring 33, which then secures the device in the closing position.

To open the connecting device, the strap 38 has simply to be pulled upwards, specifically counter to the force of the tensile spring 33, until it reaches the position according to FIG. 7. After the dead centre has been exceeded, the tensile spring 33 pulls the movable unit into the position according to FIG. 6 in which the shoe can be lifted off the snowboard. The connecting device is again ready to be stepped on.

I claim:

1. A controllably closable and releasable connecting binding for connecting sports equipment to a user's foot, which connecting binding is connected to the sports equipment via a base plate, comprising an instep engaging element and a heel engaging element which can be pivoted about a transverse axis, said elements being connected to one another by a mechanical linkage of coupled rigid links so that said links move from a position releasing the foot from the binding into a position securing the foot within the binding and vice versa, wherein said connecting binding is characterized in that at least a portion of said instep engaging element is connected to said linkage, wherein said linkage is connected to actuate said heel element, and wherein said linkage includes a spring connected to secure said instep element and said heel element and in their respective open or closed positions;

said rigid links of said mechanical linkage are pivotally coupled at coupling points, wherein at least one connecting link is provided which is lengthened beyond its coupling point on said heel element, and wherein said spring acts upon the lengthened portion of said connecting link.

2. A connecting binding according to claim 1, wherein said instep element is connected to said linkage on each side of the foot.

3. A connecting binding according to claim 1, wherein said linkage comprises a toggle joint comprising a tilting lever.

4. A connecting binding according to claim 1, wherein said heel element has a step clip in operative communication with said linkage.

5. A connecting binding according to claim 4, wherein said step clip is movable with respect to said heel element in response to the user's weight.

6. A connecting binding according to claim 1, wherein said linkage includes a clamping lever that has a lengthened portion extending beyond the coupling point of said connecting link, wherein said lengthened portion forms a connecting member for a catch strap or handle.

7. A connecting binding according to claim 1, wherein said heel engaging member has a connecting link that is lengthened beyond its coupling point to said clamping lever, said lengthened portion having a connecting member for a catch strap or handle.

8. A connecting binding according to claim 6, wherein a catch strap is provided as a handle.

9. A connecting binding according to claim 1, wherein said heel engaging member includes two said connecting links combined to form a web shape which extends around the outside of said heel element.

10. A connecting binding according to claim 9, wherein said spring is provided to act upon said web part of said connecting link.

11. A connecting binding according to claim 10, wherein said spring is a tensile spring and is attached to said heel element above said web part of said connecting link.

12. A connecting binding according to claim 9, wherein said web part of said connecting link has an opening lug for actuating said mechanical linkage for opening said binding.

13. A connecting binding according to claim 1, wherein said instep engaging element is in the form of a belt.

14. The binding defined in claim 1 wherein said coupled links comprise a toggle joint which is positioned between two other links.

15. The binding defined in claim 1 wherein said linkage includes a connecting link secured to said heel elements, and wherein said spring is a tensile spring connected to load said connecting link in a downward direction.

16. The binding defined in claim 15 wherein said tensile spring is hung onto a spindle of said heel element.

17. The binding defined in claim 15 wherein a cable or strap is connected to said connecting link and is also connected through an eyelet affixed to an upper portion of said heel element.

18. The binding defined in claim 17 wherein a finger loop is provided at the end of said cable or strap, above said eyelet.

19. The binding defined in claim 15 wherein said connecting link is shaped as a handle to catch a cable or strap.

20. A binding defined in claim 1, wherein said instep engaging element is held on each side of the user's foot by connection through a clamping lever by eccentric spindles.

21. A binding defined in claim 1 wherein said coupled rigid links include a clamping lever connected by an eccentric spindle to said instep engaging member and a heel grasping lever connected by a toggle joint to said clamping lever, and wherein said heel engaging member has a spindle about which said heel engaging member may swing, thereby forming a toggle joint capable of extending and retracting, and wherein, in the extended position, said toggle joint is located forwardly of said spindles.

* * * * *